US005711214A

United States Patent [19]

Lauderbaugh et al.

[11] Patent Number: 5,711,214

[45] Date of Patent: Jan. 27, 1998

[54] APPARATUS FOR DISSIPATING MOISTURE FROM AN ITEM

[76] Inventors: David M. Lauderbaugh, 8205 Overview Ct., Roswell, Ga. 30076; Park C. Jeans, III, 503 Pineland Cir., Mableton, Ga. 30059; Larry L. Tallant, 2735 Roper Rd., Cumming, Ga. 30130; James D. McDearis, 4030 Belvedere Dr., Gainesville, Ga. 30506; Bradley L. Vogel, 3049 Mill Run Ct., Duluth, Ga. 30136

[21] Appl. No.: 664,984

[22] Filed: Jun. 14, 1996

Related U.S. Application Data

[62] Division of Ser. No. 125,647, Sep. 22, 1993, Pat. No. 5,526,739.

[51] Int. Cl.[6] ..... B30B 5/02

[52] U.S. Cl. ..... 100/48; 100/154; 100/269.03; 100/269.04; 156/470; 156/583.5

[58] Field of Search ..... 100/48, 151, 154, 100/211, 258 R, 269.02, 269.03, 269.04; 156/206, 470, 581, 583.5

[56] References Cited

U.S. PATENT DOCUMENTS

| | | | |
|---|---|---|---|
| 633,665 | 9/1899 | Spaulding . | |
| 697,287 | 4/1902 | Spaulding . | |
| 905,076 | 11/1908 | Hinde . | |
| 2,252,585 | 8/1941 | Swanson et al. | 34/160 |
| 2,300,982 | 11/1942 | Slagboom et al. | 38/2 |
| 2,394,941 | 2/1946 | Smith | 100/258 R |
| 2,508,216 | 5/1950 | Bonds et al. . | |
| 2,554,968 | 5/1951 | Thompson | 100/35 |
| 2,941,573 | 6/1960 | Cassady . | |
| 3,190,215 | 6/1965 | Howard et al. | 100/257 |
| 3,217,425 | 11/1965 | Nikkel | 34/49 |
| 3,319,353 | 5/1967 | Matsunami et al. | 34/155 |
| 3,434,901 | 3/1969 | Griffiths et al. | 156/210 |
| 3,444,029 | 5/1969 | Renaud et al. | 156/380 |
| 3,468,734 | 9/1969 | Shields | 156/210 |
| 3,580,795 | 5/1971 | Eichenlaub | 156/583 |
| 3,607,523 | 9/1971 | McGirr | 156/210 |
| 3,676,268 | 7/1972 | Brandenburg et al. | 156/548 |
| 3,753,838 | 8/1973 | Brandenburg | 156/555 |
| 3,783,097 | 1/1974 | Justus | 100/151 |
| 3,829,338 | 8/1974 | Hayasi et al. | 156/64 |
| 3,981,758 | 9/1976 | Thayer et al. | 156/64 |
| 4,042,446 | 8/1977 | Lawton | 156/359 |
| 4,049,485 | 9/1977 | Iverson | 156/351 |
| 4,079,617 | 3/1978 | Whiting | 72/404 |

(List continued on next page.)

FOREIGN PATENT DOCUMENTS 2233935 1/1991 United Kingdom .

OTHER PUBLICATIONS

A Practical Solution to Double Facer Problems, Technical Report, 3 pages, no date.

*"Short Press" Heat Transfer System, A Retrofit Package for Existing Double Facers*, SCM Container Machinery, 19 pages, no date.

Curley, *Double Backer Developments: Change is the Constant at Schiffenhaus Industries*, Board Converting News, vol. 9, No. 18, 4 pages (May 24, 1993).

*Primary Examiner*—Stephen F. Gerrity
*Attorney, Agent, or Firm*—Jones & Askew, LLP

[57] ABSTRACT

The present invention is directed to an apparatus and method for applying variable pressure to a surface. The apparatus includes a frame secured to a fixed structure and located proximate to the surface. The frame is in movable relation with a pressure applicator in a direction substantially perpendicular to the surface. The pressure applicator is connected to a pressure source. The pressure applicator contacts the surface. A mechanical compensator is mounted integrally with the pressure applicator to enable the pressure applicator to compensate for any variations in the contour of the surface. The present invention also includes a control device for varying the pressure supplied to the pressure applicator that is ultimately applied to the surface.

20 Claims, 9 Drawing Sheets

U.S. PATENT DOCUMENTS

| | | | |
|---|---|---|---|
| 4,080,241 | 3/1978 | Grevich et al. | 156/498 |
| 4,101,370 | 7/1978 | Russell | 100/154 |
| 4,128,677 | 12/1978 | Hoelzinger | 428/57 |
| 4,268,341 | 5/1981 | Huhne | 156/353 |
| 4,286,490 | 9/1981 | Spengler . | |
| 4,306,932 | 12/1981 | Bradatsch et al. | 156/462 |
| 4,316,755 | 2/1982 | Flaum et al. | 156/205 |
| 4,467,537 | 8/1984 | Trötscher | 34/155 |
| 4,816,103 | 3/1989 | Ernest | 156/205 |
| 4,887,362 | 12/1989 | Rautakorpi | 34/41 |
| 5,005,473 | 4/1991 | Ishibashi | 100/154 |
| 5,122,220 | 6/1992 | Seki | 156/470 |
| 5,181,330 | 1/1993 | Schoch | 34/162 |
| 5,183,525 | 2/1993 | Thomas | 156/470 |
| 5,256,240 | 10/1993 | Shortt | 156/470 |
| 5,261,997 | 11/1993 | Inselmann | 156/580 |
| 5,337,656 | 8/1994 | Hollnagel | 100/98 R |
| 5,340,432 | 8/1994 | Schulz et al. | 156/472 |
| 5,344,520 | 9/1994 | Seki et al. | 156/472 |
| 5,360,506 | 11/1994 | Thomas | 156/470 |
| 5,437,752 | 8/1995 | Lang | 156/210 |
| 5,456,783 | 10/1995 | Sissons | 156/210 |
| 5,466,329 | 11/1995 | Marschke | 156/470 |
| 5,501,762 | 3/1996 | Marschke et al. | 156/470 |
| 5,526,739 | 6/1996 | Lauderbaugh et al. | 100/48 |
| 5,611,267 | 3/1997 | Lauderbaugh | 100/38 |

APPARATUS FOR DISSIPATING MOISTURE FROM AN ITEM

This is a division of application Ser. No. 08/125,647, filed Sep. 22, 1993, is now U.S. Pat. No. 5,526,739.

TECHNICAL FIELD

This invention relates to a method and apparatus for providing variable pressure to a surface. In particular, the present invention is directed to a method and apparatus for providing a variable pressure to a moving belt in contact with adhering layers of corrugated board.

BACKGROUND OF THE INVENTION

This invention is directed primarily to the corrugated board industry. Corrugated board is manufactured by first adhering a first flat liner to a median having a plurality of evenly spaced ridges (corrugations) thereon. This is accomplished by running the median through a corrugator which forms the ridges or corrugations. This first liner/median combination is then adhered to a second liner at a glue station. The two layers have adhesive applied therebetween.

The adhering layers then pass through a section of the assembly line where heat and pressure are applied to cause the layers to effectively adhere to one another. This section of the assembly line is often referred to as the "double facer" section. The double facer section of the assembly line includes a hot plate section and a cooling section. The hot plate section includes a means for applying pressure and heat to the adhering layers to accelerate the adhering process. In the hot plate section, the adhering layers pass below a pressure applicator and above a heat source.

The adhering layers then move into the cooling section which includes belts located both above and below the corrugated board. The belts contact the adhering layers and move it through the assembly line. The board cools as it moves through the cooling section. The adhesive between the layers cools as the board passes through the cooling section which completes the adhesion process. Once adhesion is effectively complete, the corrugated board is moved on through the assembly for cutting into various shapes for chests, cases, cartons and the like.

This invention has particular application to the hot plate section of the corrugated board manufacturing process. When the corrugated board passes through the hot plate section, the adhering layers pass over steam chests. The steam chests have steam supplied thereto by a boiler. The steam is cycled through the steam chests to heat the chests to an ideal temperature of approximately 355° F. When the layers pass over the steam chests, the heat dries the board and the adhesive, which is typically a starch based adhesive.

In addition to heat, adhesion and board uniformity are accelerated by applying pressure to the adhering layers. In a typical corrugated board assembly plant, the adhering layers pass between the steam chests and a continuous belt, known as a corrugator belt. Corrugator belts are located in the hot plate section and the cooling section of the double racer. In the cooling section, the layers pass between two corrugator belts, which are compressed by a series of rigid weight rollers. The corrugator belts must contact the layers in order to move the layers through the assembly line.

In a typical hot plate section, the belt is compressed onto the board by a series of rigid roller bars rotatably mounted to a frame located proximate to the adhering layers of corrugated board. The roller bars contact a continuous belt, a corrugator belt which contacts the adhering layers. The pressure supplied by the roller bars serves to dry the corrugated board and the adhesive thus creating a bond between the layers. The removal of moisture from the corrugated board is critical to the control of warpage. This moisture is removed in the hot plate section by heat transfer from the contact with the steam chests. This contact must be throughout the entire surface of the board in order to control its quality. The moisture removal from the corrugated belt is also critical, since when the belt becomes saturated, moisture may then only escape the board at the edges. The lack of moisture removal creates warped board. The pressure in this section also serves to apply continuous contact to the belt and the adhering layers which pulls the corrugated board through the double facer. In the cooling section, which is the main pulling section for the board, the board is held between the same upper corrugator belt, and a lower corrugator belt instead of steam chests. These belts are typically kept in contact with the board by a series of rigid roller bars. The compression applied by the roller bars serves to increase the friction between the belts and board, which pulls the board through the double facer.

Turning now to the hot plate section of the corrugated assembly line, as the steam chests heat, they warp and deform. When the board passes over the hot plate section, it has been found that heat is only transferred at points of contact between the steam chests and corrugated board. The deflection of the steam chests cause gaps between the board and chests. These air gaps do not permit the board to dry, which creates warped corrugated board, which in turn wastes manufacturing and down time, and wastes materials. Thus, it is critical in the hot plate section that pressure is applied to the board over as much of the surface area as possible. In addition, because the rigid roller bars only apply pressure to the layers at a tangential point along the roller bar, the time and point of contact is minimal. A more effective method of applying pressure to the layers would be to increase the surface contact and the time in which the pressure is applied.

Corrugated manufacturers also experience occasional crushing of the corrugations or ridges or "flutes" of the board as it passes through the hot plate section. This problem occurs primarily when the adhering layers pass between the roller bars and warped areas of the steam chests. The problem of flute crush is particularly increased at the edges of the corrugated board. Where the moisture from the adhesion process lingers making the edges of the corrugated board the last to dry. Due to this lingering moisture, the edges of the board become especially susceptible to crush by the roller bars due to the high force generated by the tangential point on the roller bar and the weakness of the adhering layers due to the retained moisture. It would be advantageous to have a device and method that applied pressure in the double facer section of the corrugated manufacturing process evenly over a large number of flutes so that the problem of flute crush would be eliminated. It would also be advantageous to provide a device and method that effectively absorbs and dissipates the moisture in the adhesive of the adhering layers of corrugated board as the layers pass through the double facer section.

Because the roller bars pass over the layers for a short period of time, the number of steam chests and thus the length of the assembly line, must increase to insure that the adhesion between the layers is complete before the corrugated board is passed to the next section of the assembly line. Additional steam chests increase manufacturing time and cost due to the additional energy needed to operate the boilers which supply steam to the steam chests. In addition, the steam chests take up considerable space along the assembly line and increase the length of the assembly line. It would be advantageous to increase the contact between the adhering layers of the corrugated board and the steam box so as to create an effective adhesion in a shorter period of time. This would allow the corrugated board manufacturer to either decrease the length of the assembly line or increase the speed at which the corrugated board passes therethrough.

The present use of roller bars also causes problems when a foreign object, such as a large deposit of adhesive, moves between the layers and the belt. The roller bars cannot compensate for such a situation. This results in ripping of the belt or board, or jamming the feed of the board through the hot plate section. It would be desirable to have a means for applying pressure to adhering layers of corrugated board where the pressure applicator is retractable. This would allow the pressure applicator to retract when a foreign object passes underneath so as not to rip the belt or board or cause the board feed to jam.

The present use of roller bars also causes problems in the cooling section of the double facer. The cooling section is primarily responsible for pulling the corrugated board through the double facer section of the corrugated assembly line. In this section, the board is compressed between two corrugator belts as previously mentioned. The pressure is supplied by a series of roller bars rotatably mounted above and below the board and in contact with the corrugator belts. As discussed in detail above, this compression at the tangent points of the roller bars causes flute crush and increases the energy cost due to minimal contact with the frictional pulling forces from the belts compressed by the roller bars. It would be desirable to have a device and method of applying pressure to adhering layers of corrugated board as they pass through the cooling section of the double facer so that flute crush is eliminated and contact with the surface area of the adhering layers is increased so as to increase the rate at which heat and moisture dissipates from the board. An increase in contact between the pressure applicator and the surface area of the board would also decrease the energy needed to pull the board through the double facer. This would enable a plant to shorten the cooling section of the double facer and gain valuable manufacturing space and flexibility to run at higher speeds with an increase in energy savings.

Corrugator belts tend to be extremely expensive. A typical belt costs a manufacturer approximately $18,000. Thus, it is important for the manufacturer to maximize the belt life.

With regard to the present application, the weight of the roller bars against the belt tends to wear the belt and causes and unnecessary decrease in the belt life. This increases manufacturing costs and down time to replace the belt. It would be advantageous to provide a device and method that applies pressure to the belt and corrugated board where the friction therebetween is minimized so as to increase belt life and enable the manufacturer to increase the speed at which corrugated board is produced. The weight of the weight rollers on the belt also causes significant drag. This causes substantial belt wear and early replacement of the belt which increases the overall manufacturing cost.

In addition to the problems described above, the use of the presently existing rotatably mounted roller bars requires considerable alignment, such as the use of alignment bearings and pins. These components require continuous maintenance, repair and replacement. This increases the manufacturer's overhead costs as well as time in the maintenance and down time when the roller bars are removed and replaced on the assembly line. It would be advantageous to have a corrugated board assembly wherein the pressure applied to the adhering layers of the corrugated board in the hot plate section was not dependent upon a series of alignment bearings and pins.

The prior art has failed to address the problems discussed herein. One device has replaced the roller bars with a series of flat plates connected to a frame by means of mechanical springs. This increases the surface area and time of contact between the adhering layers and the steam chests. However, the constant pressure of the mechanical springs does not compensate for changes in the shape of the steam chests as they deform as a result of increased heat. In addition, the flat plates have smooth bottoms that are in constant contact with the belt throughout their surface areas. These plates have no way of dissipating the heat and moisture so that the adhesion process is accelerated.

Another device attempted to solve the heat deformation problem by substituting the alignment bearings of the roller bars with a pressurized air bladder. Under pressure the air bladder acts as a shock absorber and provides a cushion to compensate, in part, for the deformation of the steam chests. However, because the roller bars are rigid, the increase in surface area contact between the adhering layers and the steam chest is minimal.

This device also attempted to increase the surface contact between the pressure applicator and the steam chest by providing for a continuous belt of mail. The weight of the mail against the steam chests increases the pressure against the adhering layers of corrugated board. However, the drag coefficient of the mail against the felt belt is considerably higher than conventional roller bars. As a result, this device requires a significant increase in energy to move the belt and adhering layers of corrugated board through the assembly line. In addition, the friction between the mail and the belt significantly decreases the belt life which further increases the cost of manufacturing.

Thus, there is a need for a device that applies variable pressure to adhering layers of corrugated board as they pass over stem chests in a hot plate section of a corrugated board assembly line so as to compensate for the heat deformation of the steam chests.

There is a further need for a device that applies pressure over an increased surface area of adhering layers of corrugated board as they pass over the steam chests.

There is still a further need for a device that varies the pressure applied to adhering layers of corrugated board across the width of the board as it moves through a hot plate section.

There is yet a further need for a device that decreases the time required to effectively adhere layers of corrugated board together which thus enables a corrugated board manufacturer to decrease the size of the hot plate section of the corrugated board assembly line.

There is still a further need for a device that applies variable pressure to adhering layers of corrugated board to effectively adhere such layers so as to enable a corrugated board manufacturer to increase the speed at which the adhering layers of corrugated board are fed through the hot plate section of a corrugated manufacturing facility.

There is yet a further need for a device that supplies variable pressure to adhering layers of corrugated board and a moveable belt as they pass through the hot plate section of a corrugated board assembly line where the friction therebetween is decreased.

There is even yet a further need for a device that provides variable pressure to a moveable belt and adhering layers of corrugated board so as to increase the belt life.

There is yet a further need for a device that provides variable pressure to adhering layers of corrugated board without deforming the adhering layers.

There is a further need for a device that quickly and effectively dissipates moisture and heat from adhering layers of corrugated board so as to prevent flute crush and decrease manufacturing time.

There is also a need for a method of applying variable pressure to adhering layers of corrugated board as they pass over steam chests in a hot plate section of a corrugated board assembly line so as to compensate for the heat deformation of the steam chests.

There is a further need for a method of applying pressure over an increased surface area of the adhering layers of corrugated board as they pass over the steam chests.

There is still a further need for a method of varying pressure applied to adhering layers of corrugated board across the width of the board as it moves through the hot plate section.

There is yet a further need for a method of applying variable pressure to adhering layers of corrugated board so as to decrease the time required to effectively adhere layers of corrugated board together and thus enable the manufacturer to decrease the size of the hot plate section of the corrugated board assembly line.

There is still a further need for a method of applying variable pressure to adhering layers of corrugated board that enables a corrugated board manufacturer to increase the speed at which the adhering layers of corrugated board are fed through the hot plate section as a result of more effective adhesion techniques.

There is yet a further need for a method of applying variable pressure to adhering layers of corrugated board and a belt so as to decrease the friction therebetween.

There is even yet a further need for a method for applying variable pressure to adhering layers of corrugated board so that the belt life is increased.

There is yet a further need for a method for applying variable pressure to adhering layers of corrugated board without deforming the adhering layers.

There is a further need for a method for applying variable pressure to adhering layers of corrugated board so that heat and moisture are quickly and effectively dissipated, flute crush is prevented and manufacturing time is decreased.

SUMMARY OF THE INVENTION

As will be seen, the present invention overcomes these and other disadvantages associated with prior art pressure applicators. Stated generally, the present invention comprises a frame proximate to a surface. A pressure applicator is connected to a pressure source. The pressure applicator slides in relation to the frame in a direction substantially perpendicular to the surface. The pressure applicator contacts the surface. A mechanical compensator is integral with the pressure applicator to enable the pressure applicator to compensate for any deformities in the surface. The present invention also includes a control means for varying the pressure applied to the surface.

Stated somewhat more specifically, the present invention comprises a frame proximately located to a surface. The frame is secured to a fixed structure. A plate is oriented parallel to the surface and slides within the frame. The frame has an expandable volume therein. The expandable volume receives pressurized fluid and the expandable volume is in contact with the plate. A rod extends substantially perpendicular from the plate toward the surface. A foot is pivotably mounted to the rod. The foot contacts the surface. A pressure controller controls the flow of fluid into the expandable volume to vary the pressure applied to the surface.

Thus, it is an object of the present invention to provide a device that applies variable pressure to adhering layers of corrugated board as they pass over steam chests in a hot plate section of a corrugated board assembly line so as to compensate for the heat deformation of the stem chests.

It is a further object of the present invention to provide a device that applies pressure over an increased surface area of adhering layers of corrugated board as they pass over the steam chests.

It is still a further object of the present invention to provide a device that varies the pressure applied to adhering layers of corrugated board across the width of the board as it moves through the hot plate section.

It is yet a further object of the present invention that provides for a device that decreases the time required to effectively adhere layers of corrugated board together which thus enables the corrugated board manufacturer to decrease the size of the hot plate section.

It is still a further object of the present invention that provides for a device that applies variable pressure to adhering layers of corrugated board to effectively adhere such layers and enables a corrugated board manufacturer to increase the speed at which the adhering layers of corrugated board are fed through the hot plate section.

It is yet a further object of the present invention to provide a device that applies variable pressure to adhering layers of corrugated board and a moveable belt as they pass through the hot plate section of a corrugated board assembly line where the friction therebetween is decreased.

It is even yet a further object of the present invention that provides for a device that provides variable pressure to adhering layers of corrugated board and a moveable belt wherein the belt life is increased.

It is yet a further object of the present invention that provides for a device that provides variable pressure to adhering layers of corrugated board without deforming the adhering layers.

It is also another object of the present invention that provides for a method of applying variable pressure to adhering layers of corrugated board as they pass over steam chests in a corrugated board assembly line so as to compensate for the heat deformation of the steam box.

It is a further object of the present invention that provides for a device that quickly and effectively dissipates moisture and heat from adhering layers of corrugated board so as to prevent flute crush and decrease manufacturing time.

It is a further object of the present invention that provides for a method of applying pressure over an increased surface area of adhering layers of corrugated board as they pass over the steam chests.

It is a further object of the present invention to provide a method of applying varied and predetermined pressure to adhering layers of corrugated board across the width of the board as it moves through the hot plate section.

It is yet a further object of the present invention that provides for a method of applying variable pressure to adhering layers of corrugated board that decreases the time required to effectively adhere the layers together and thus enable the manufacturer to decrease the size of the hot plate section of the assembly line.

It is still a further object of the present invention that provides for a method of applying variable pressure to adhering layers of corrugated board to effectively adhere the layers and enables a corrugated board manufacturer to increase the speed at which the adhering layers of corrugated board are fed through the hot plate section.

It is yet a further object of the present invention to decrease the friction between adhering layers of corrugated board and a moveable belt as they pass through the hot plate section of a corrugated board assembly line.

It is even yet a further object of the present invention that provides for a method of applying variable pressure to adhering layers of corrugated board and a moving belt so that the belt life is increased.

It is yet a further object of the present invention that provides for a method of applying variable pressure to adhering layers of corrugated board without deforming the adhering layers.

It is still a further object of the present invention that provides for a method for applying variable pressure to adhering layers of corrugated board so that heat and moisture quickly and effectively dissipate to prevent flute crush and decrease manufacturing time.

Other objects, features and advantages of the present invention will become apparent upon reading the following specification, when taken in conjunction with the drawings and appended claims.

DETAILED DESCRIPTION OF THE INVENTION

Figure 1:
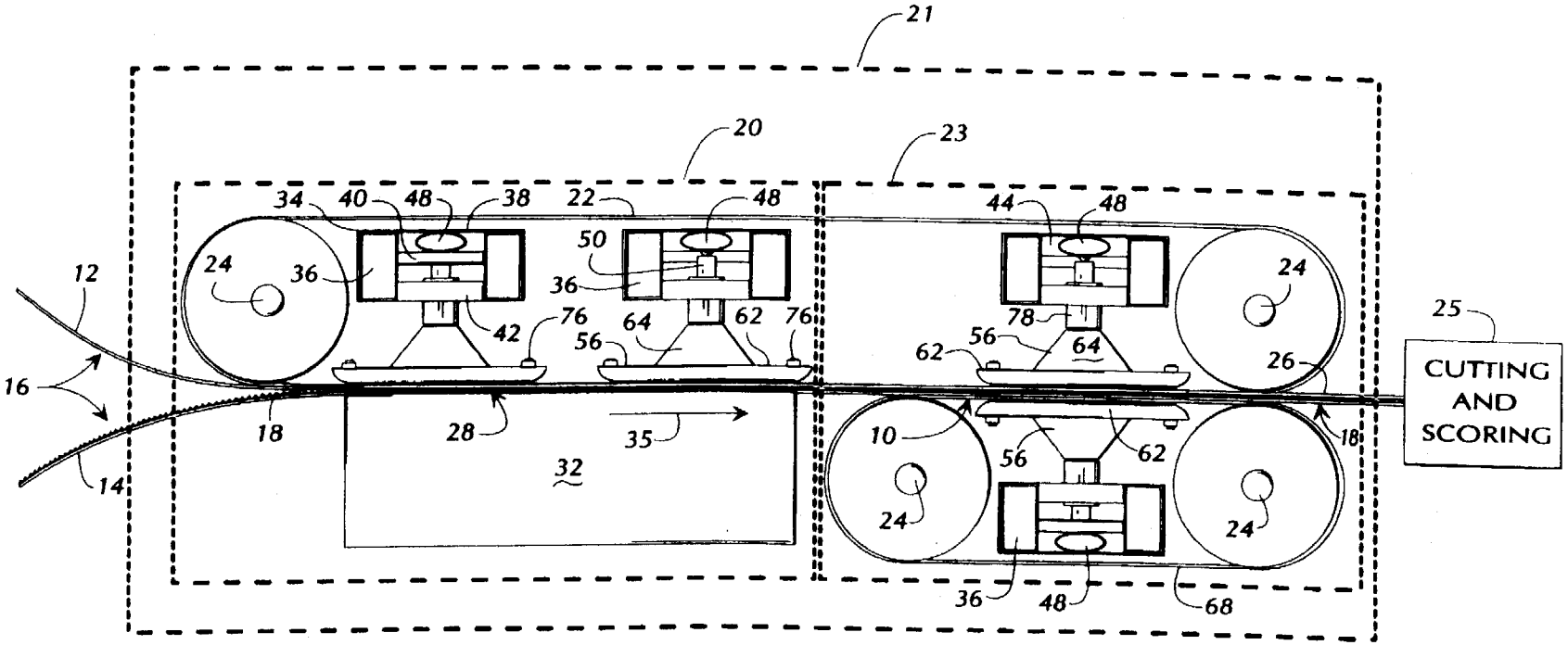
FIG. 1 is an overall schematic of a portion of the corrugated board manufacturing process incorporating a preferred embodiment of the present invention.

Referring now to the drawings, in which like numerals indicate like elements throughout the several views, FIG. 1 shows a schematic representation of corrugated board as it moves through a portion of a typical manufacturing facility. The corrugated board 10 comprises a liner 12 and a liner/median combination 14. The liner 12 and liner/median combination 14 are coated with an adhesive 16 and are placed so that the coated surfaces are in contact with one another throughout the surface areas. The liner 12 and liner/median combination 14 with adhesive 16 therebetween are referred throughout this description as adhering layers 18. The adhering layers 18 of corrugated board 10 pass through a hot plate section 20 of a double facer area 21 of the corrugated board assembly where the board 10 is subject to increase pressure and heat to quickly and effectively cause the adhering layers to bond to one another. After the board 10 passes through the hot plate section 20, the board passes through the cooling section 23 of the double facer area 21 where the adhering layers 18 cool and the adhesion process is complete. From the cooling section 23, the board 10 passes on to the cutting section 25 where the board is cut, scored and formed into boxes, cases, cartons and the like.

The present invention focuses on the application of a variable pressure in the double racer area 21 of a corrugated board manufacturing facility.

In a typical corrugated board manufacturing facility, the liner 12 and the liner/median combination 14 are joined with the adhesive 16 therebetween. The adhesive 16 is typically a starch based product containing water. When the water evaporates from the product, the adhesive 16 is fully dried and the layers 18 adhere to one another.

Figure 2:
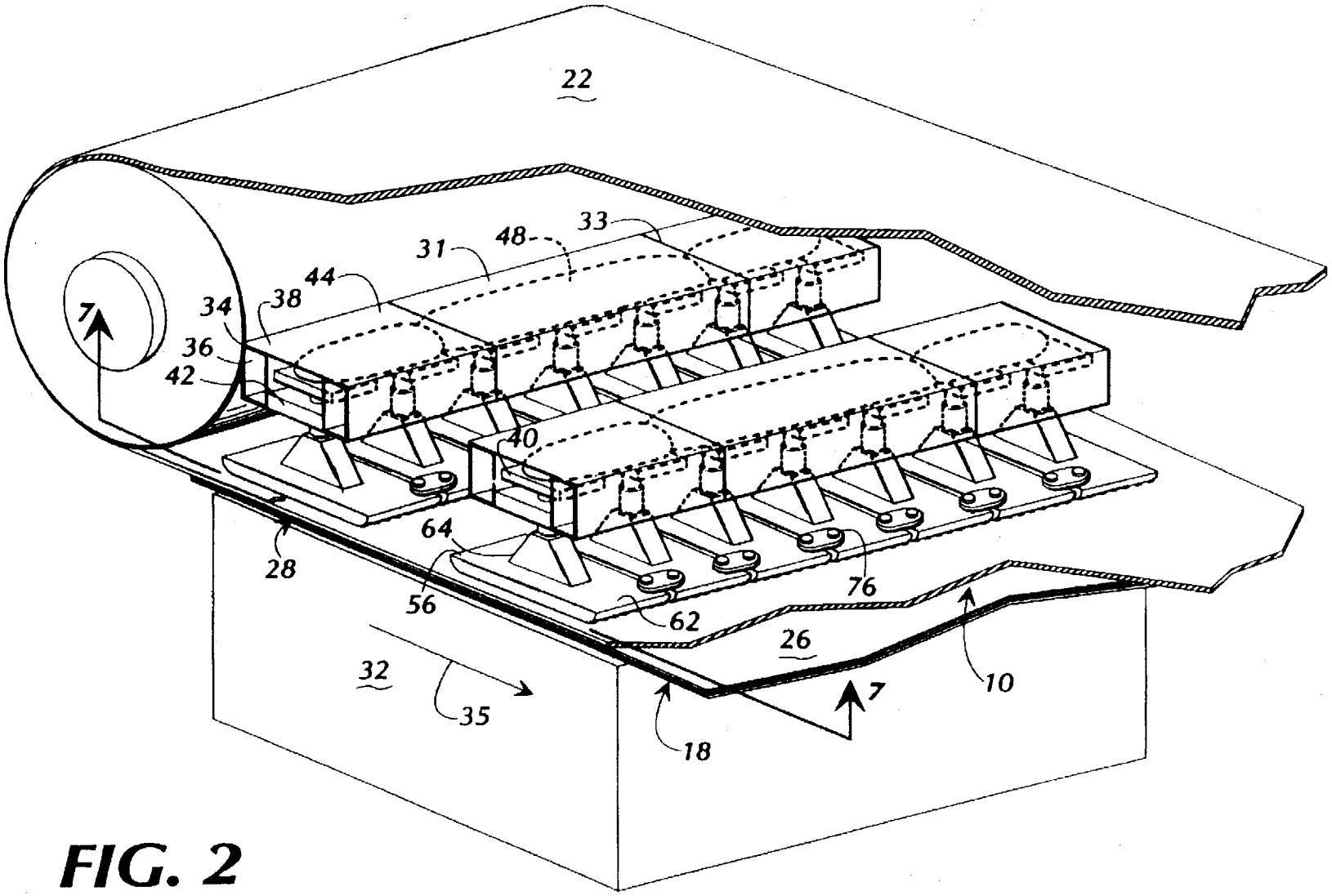
FIG. 2 is an overall perspective view of the preferred embodiment of the FIG. 1.

To accelerate this process, pressure and heat are applied to the adhering layers 18 in the hot plate section 20. A continuous upper belt 22 feeds the adhering layers 18 through the double facer area 21. The upper belt 22 is supported at opposing ends by rotating shafts 24. The shafts 24 are driven by electric motors (not shown) that supply the power to provide rotary motion to the shafts. As the adhering layers 18 pass through the hot plate section 20, the upper surface area 26 of the adhering layers 18 contacts the upper belt 22 as shown in FIGS. 1, 2 and 4. In the hot plate section 20 of the double facer area 21, the lower surface area 28 of the adhering layers 18 contacts the upper surfaces 30 of a series of steam chests 32 as shown in FIG. 1. A boiler (not shown) supplies steam to the steam chests. Steam is cycled through the chests 32 and returned to the boiler to be reheated and cycled through again. In optimum operating conditions, the steam chests 32 reach a temperature of approximately 355° F. At this temperature, the upper surface 30 of each steam box 32 tends to deform. Thus, the pressure applied to the adhering layers 18 must compensate for such deformation.

When the adhering layers 18 pass through the cooling section 23 of the double facer area 21, the upper surface of the adhering layers 18 contacts the upper belt 22 and the lower surface of the adhering layers contacts a lower belt 68. Like the upper belt, the lower belt 68 is also continuous and is mounted between a pair of rotating shafts 24 in a similar arrangement as that described above with regard to the upper belt 22.

STRUCTURE OF THE INVENTION

Figure 3:
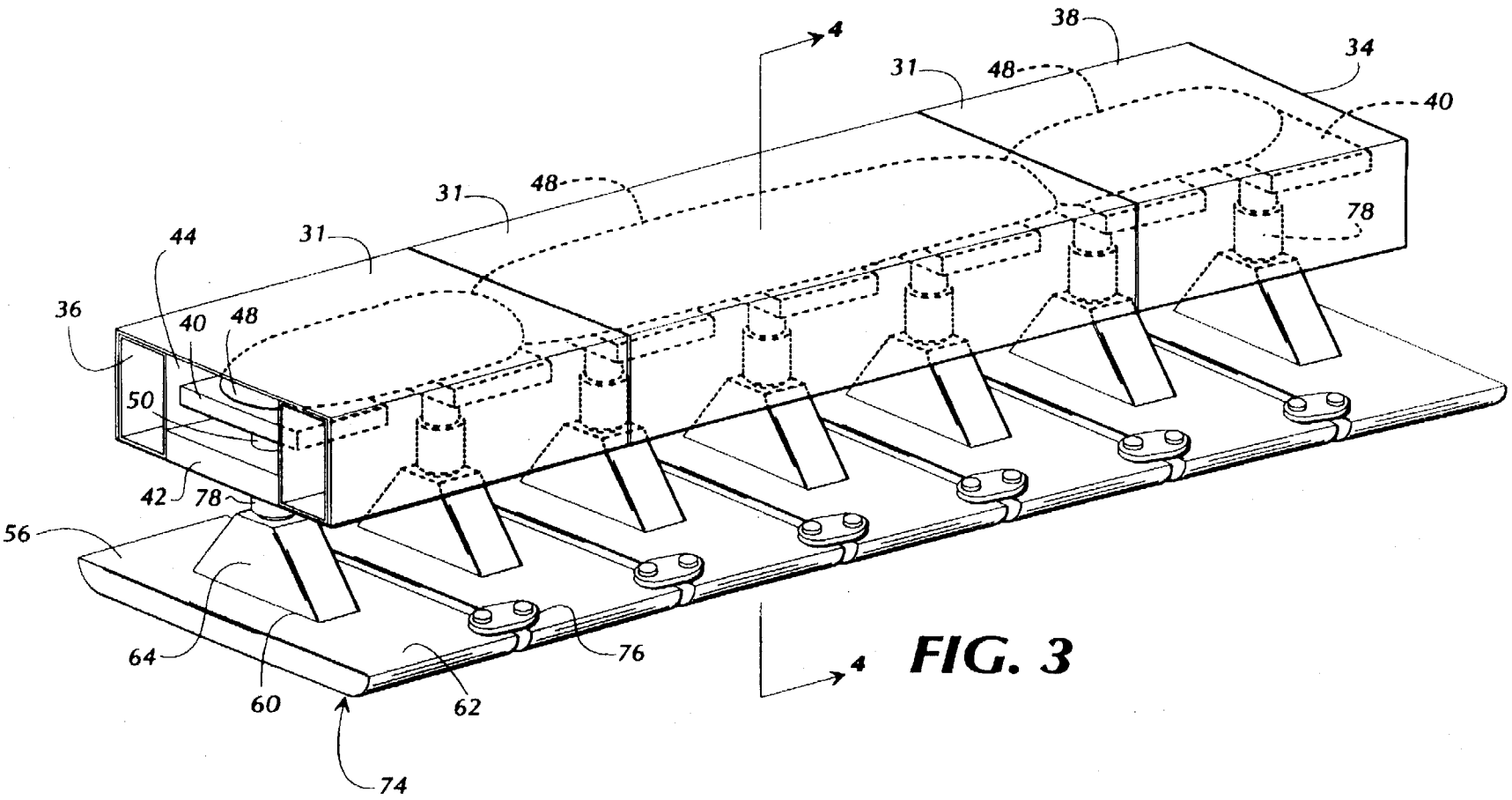
FIG. 3 is a more detailed perspective view of the preferred embodiment of FIG. 1.

Turning now to FIG. 2, a frame 34 is located above the upper belt 22. The frame 34 is mounted to a fixed structure (not shown) above the upper surface 26 of the layers 18 and oriented perpendicular to the path of travel of the layers. The path of travel is indicated by arrow 35. The frame 34 is made up of a pair of parallel spaced apart members 36, as shown in FIGS. 3 and 4. FIG. 3 shows the frame 34 separated into three longitudinally spaced sections 31 by divider plates 33. The spaced apart members 36 of the frame 34 within each section 31 are joined along their length by a cover plate 38, and a bottom plate 42. A series of parallel, spaced apart loading plates 40 are located between the cover plate 38 and the bottom plate 42 of each section 31. The cover plate 38 and loading plate 40 are spaced apart to create a sealed cavity 44 within each section of the frame 34. Each cavity 44 houses an air bladder 48. The loading plates 40 in each section 31 are in contact with the air bladder 48. Each loading plate 38 slides relative to the frame 34 in a vertical direction between the opposing surfaces of the spaced apart members 36 of the frame 34 as a result of increased air introduced into the air bladder 48. The cover plate remains stationary.

A pressure rod 50 is secured to each loading plate 40, as best shown in FIGS. 2 through 4. Each pressure rod is oriented substantially vertical and secured to the loading plate 40 by a loading plate screw 52.

Turning now to FIG. 4, each rod 50 extends through the bottom plate 42 and is held in vertical alignment by means of a linear bearing 78. The inner race of the linear bearing 78 contacts the outer periphery of the rod 50. Each linear bearing 78 is press fit into the bottom plate 42. The bottom plate 42 is located substantially parallel to and below the loading plate 40. The bottom plate 42 is spaced sufficiently apart from the loading plate 40 to allow the loading plate to move vertically relative to the frame 34.

Figure 4A:
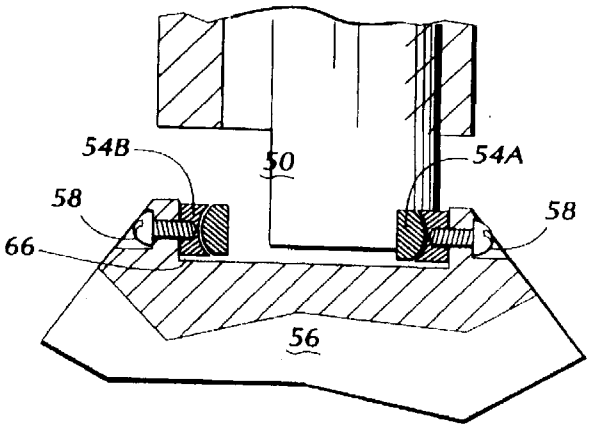
FIG. 4A is a close up view of a portion of FIG. 4.
Figure 4:
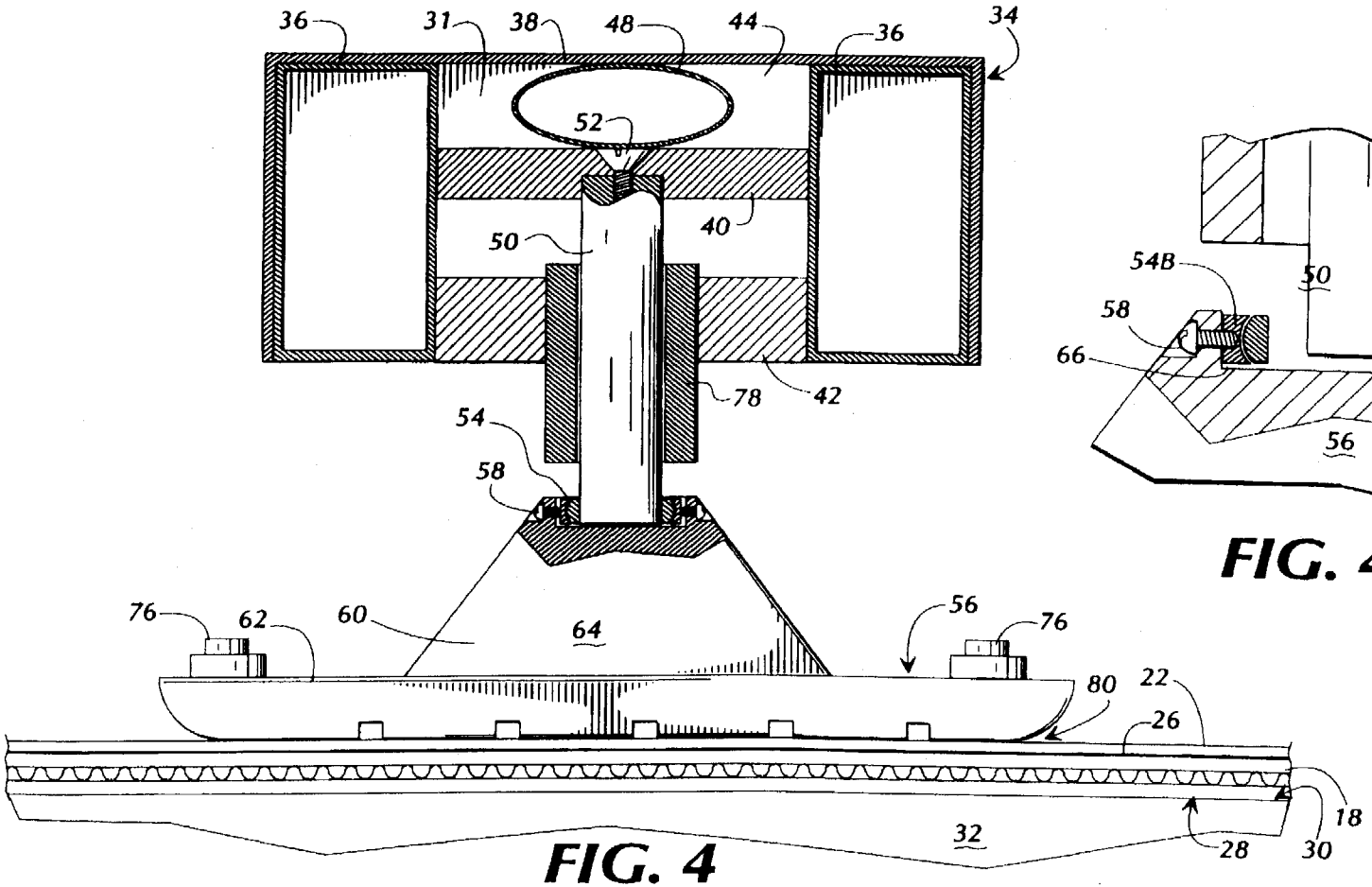
FIG. 4 is a side sectional view as seen along line 4—4 of the preferred embodiment of FIG. 3.

The free end of the pressure rod 50 is joined to a spherical bearing 54, as shown in detail in FIG. 4A. The outer diameter of the free end of the rod 50 is press fit into the inner diameter of the inner race 54A of the spherical bearing 54. The outer race 54B of the spherical bearing 54 is joined to a pressure foot 56 by means of set screws 58.

The pressure foot 56, shown in FIG. 4 comprises a foot frame 60 and a flat section 62 oriented substantially parallel to the path of travel of the adhering layers 18.

The foot frame 60 includes protruding member 64 extending upwardly and centrally from the flat section 62. The foot frame 60 has a cylindrical recess 66 along the upper surface of the frame 60. The cylindrical recess is shown in detail in FIG. 4A. The recess 66 receives the outer race 54B of the spherical bearing 54. The set screws 58 are passed through the set screw holes to the foot frame 60 into matingly tapped holes 72 in the outer race 54B to secure the foot frame to the spherical bearing 54.

Figure 5:
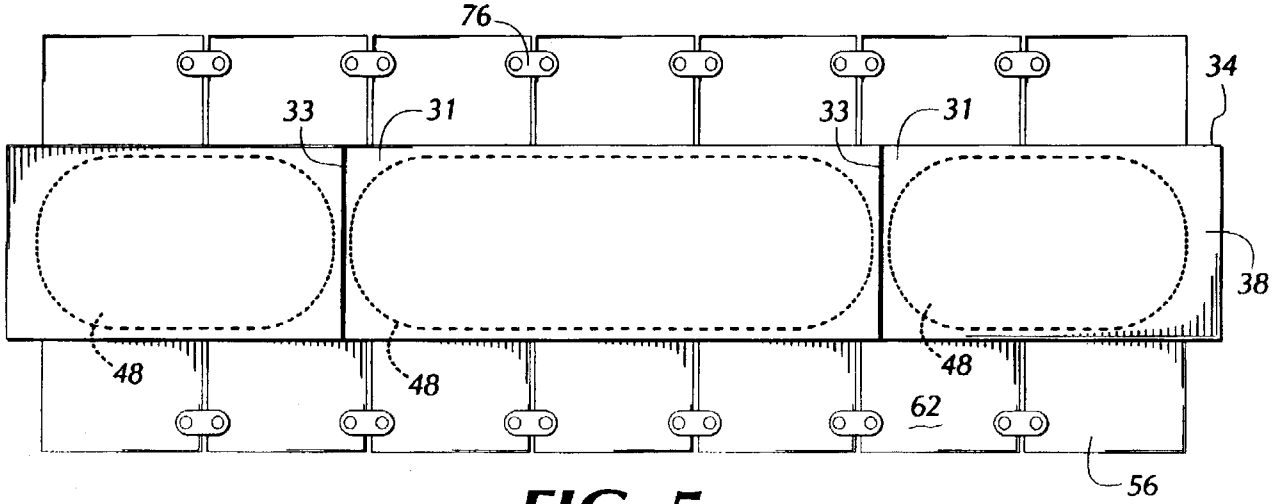
FIG. 5 is a plan view of the preferred embodiment as shown in FIG. 3.
Figure 6:
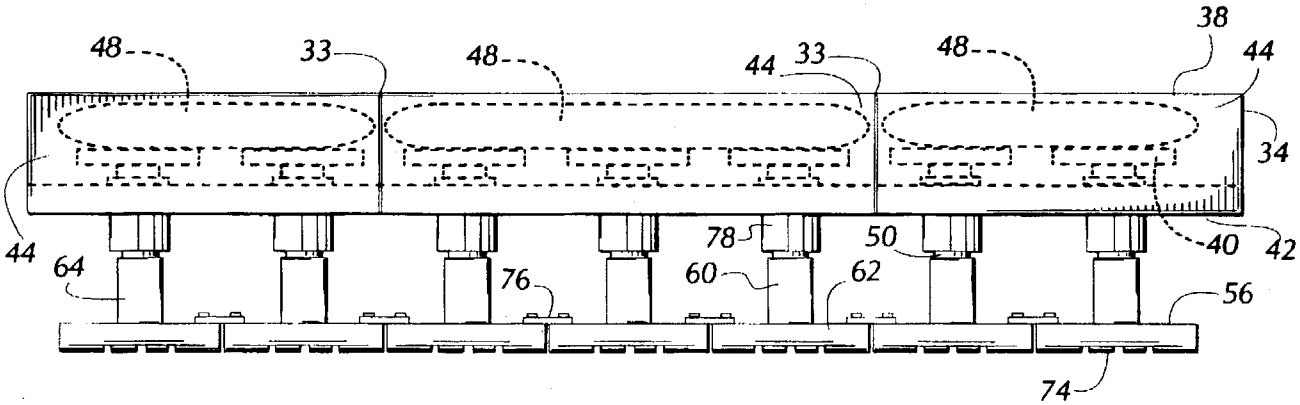
FIG. 6 is a front view of the preferred embodiment as shown in FIG. 3.

The flat section 62 of the pressure foot 56 is substantially flat and oblong, as shown in FIG. 5. The bottom of the flat section 62 is coated with an anti-friction material such as a ceramic, as shown in FIGS. 4 and 6. Other anti-friction materials, such as Teflon®, may be used if they can effectively adhere to the foot material which is preferably a cast metal.

Figure 8:
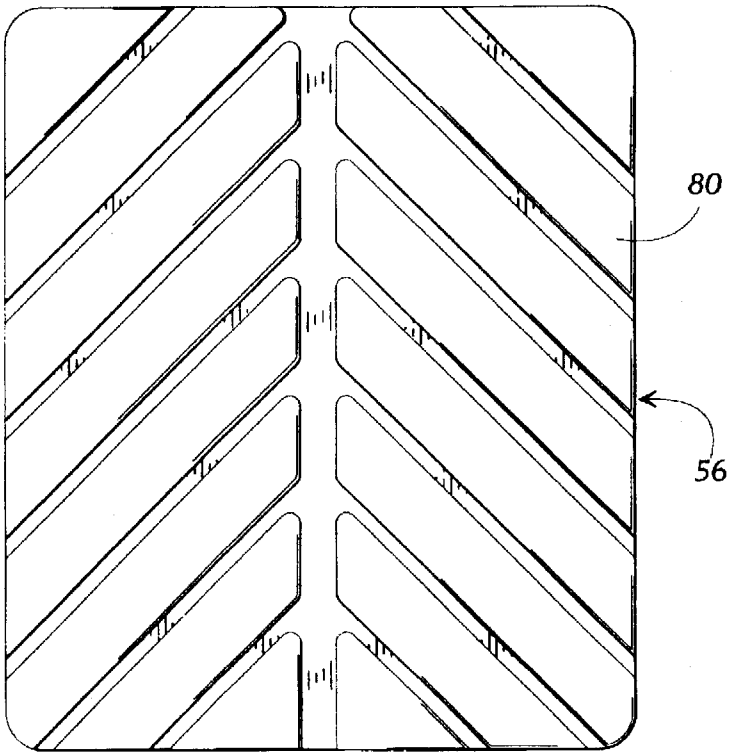
FIG. 8 is a side view of the preferred embodiment of FIG. 7.
Figure 7:
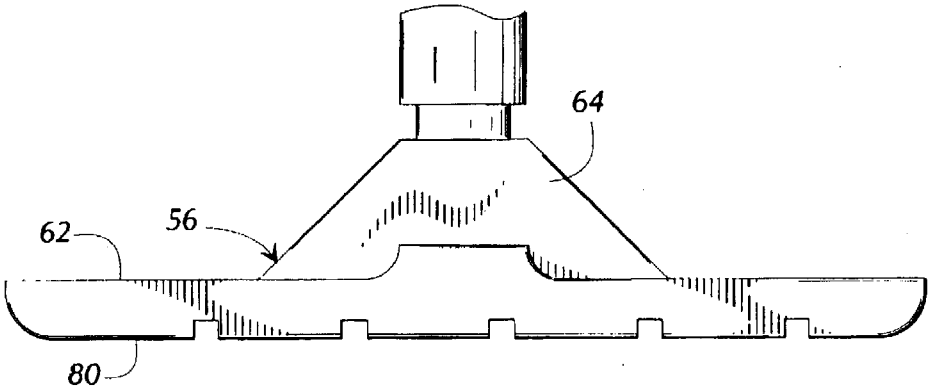
FIG. 7 is a bottom sectional view as seen along line 7—7 of the preferred embodiment of FIG. 2.

The bottom of the flat section 62 of the pressure foot 56 has a series of angled grooves 80 extending outward from the center of the bottom of the pressure foot as shown in FIGS. 7 and 8. The upper belt 22 tends to become wet when exposed to the moist adhesive. The grooves 80 allow the belt to dry while maintaining pressure on the adhering layers 18. As stated above, there are a plurality of pressure rods 50 extending from the loading plates 40. Thus, there are a plurality of pressure feet 56 extending from the loading plates 40 as well. Mechanical links 76, shown in FIGS. 5 and 6, are secured between adjacent feet 56 to prevent the feet from contacting each other and to keep the sides of the feet substantially parallel to one another.

Referring to FIG. 1 again, the adhering layers 18 of corrugated board 10 contact the upper and lower belts 22 and 68 in the cooling section 23 of the double face area 21. Pressure is applied to the upper 26 and lower 28 surface areas of the adhering layers 18 by the pressure feet 56 as described above. The pressure feet 56 are arranged as described in detail above and contact the upper belt 22 which in turn contacts the upper surface area 26 of the adhering layers 18. Additional pressure feet 56 are invertedly mounted so that pressure is also applied to the lower surface area 28 of the adhering layers 18.

OPERATION OF THE INVENTION

As stated above, the liner 12 and liner/median 14 combination have adhesive 16 applied therebetween and contact each other throughout their opposing surface areas. These adhering layers 18 are fed into the hot plate section 20 by means of the continuous upper belt 22. The upper belt 22 is driven by rotatable shafts 24 at each end. As the adhering layers 18 move through the hot plate section 20, they contact the upper belt 22 on the upper surface 26 of the layers and the steam chests 32 on the lower surface 28 of the layers. In the hot plate section 20, the pressure feet 56 are located above the belt 22. The bottom of the flat section 62 of each foot 56 contacts the belt 22.

Pressurized air is supplied to the air bladders 48 within each section 31 to a level commensurate with the degree of pressure needed to be applied to the adhering layers 18. The pressure within the air bladders 48 within each section 31 is increased by supplying the air bladder 48 with high pressure air from a compressed air tank (not shown). As the pressure in the air bladder 48 increases, the surface of the bladder 48 in contact with the loading plates 40 puts pressure on the loading plates and forces the loading plates downward. The downward motion of the loading plates 40 moves the pressure rods 50 downward also. This downward motion of the rods 50 is transferred to the pressure feet 56. The pressure feet 56 transfer the downward pressure throughout their flat sections 62 in contact with the upper belt 22. The pressure from the pressure feet 56 is ultimately transferred to the adhering layers 18.

As the adhering layers 18 pass over the upper surfaces 30 of the steam chests 32 in the hot plate section 20, the spherical bearings 54 allow the pressure feet 56 to move to compensate for any deformation of the steam chests 32. This enables each pressure foot 56 to evenly apply pressure through the upper belt 22 to the adhering layers 18 below. Such evenly applied pressure ensures that the adhering layers 18 contact each other which results in successful adhesion.

The pressure in each air bladder 48 may be different. This is designed to enable the corrugated board manufacturer to vary the pressure from the center of the board 10 to the edges, where it is typically more difficult to achieve successful adhesion.

After the adhering layers 18 pass through the hot plate section 20, the layers are pulled through the cooling section 23 by the upper belt 20 and the lower belt 68. Pressure feet 56 in contact with both the upper belt 20 and the lower belt 68 provide the friction needed to pull the adhering layers 18 through the cooling section 23. The pressure feet 56 invertedly mounted and in contact with the lower belt 68 provide pressure to the lower surface area 28 of the adhering layers 18. The invertedly mounted pressure feet 56 allow the lower surface area 28 of the adhering layers 18, which has been previously in contact with the steam chests, to cool. The grooved surface of the pressure feet 56 dissipates the moisture due to the wicking action of convection currents of air in the grooves thus allowing both upper belt 20 and lower belt 68 to dry.

In addition, the air bladder acts as a shock absorber. On occasion, a foreign object, such as a large deposit of adhesive, moves along the assembly line and gets caught between the adhering layers and the belt. In the past, if a foreign object got stuck, the rollers are incapable of compensating for such circumstance and such an object would get stuck below the roller an rip the belt, the layers, or both. When a foreign object moves between the adhering layers and the belt, each foot is capable of independent movement upward to allow the object to pass under the foot without damaging the belt or the layers. If the rod and foot cannot move any further upward, the movement of the belt and layers stops if the pressure within the air bladder reaches a preselected level.

In the hot plate section 20, because the pressure feet 56 apply pressure to a significant portion of the upper surface area 26 of the adhering layers 18, a significant surface area of the adhering layers 18 contacts the upper surface 30 of the steam chests 32 for a longer period of time. This results in effective adhesion of the layers 18 in a shorter time period. The benefits of the present invention enable corrugated board manufacturers to increase production speed or decrease the number of chests needed in the hot plate section 20. An increase in production speed results in great quantity of product. A decrease in the number of steam chests 32 results in a decrease in the floor space needed for production and a decrease in the energy needed for the steam chests 32. These result in decreasing the overall manufacturing cost which enable the manufacturer to realize an increase in profit.

As stated above, the bottom of the flat section 62 of each foot 56 is coated with an anti-friction material 74, such a ceramic. This coating allows the upper belt 22 and lower belt 68 to move under the pressure foot 56 with significantly less drag. A decrease in the drag of the belts prolongs belt life which saves in manufacturing costs and down time. Moreover, a decrease in belt drag decreases the energy required to move the belts along and enables the manufacturer to increase the belt life, and thus production speed. These benefits ultimately result in a decrease in overall manufacturing cost which enable the manufacturer to realize a higher profit.

The pressure feet 56 of the present invention requires no alignment adjustment once the assembly is installed. The pressurized air bladders 48, spherical and linear bearings keep the assembly self-aligned. This saves the manufacturer time in initial start-up as well as eliminates any need for alignment repairs or adjustments.

ALTERNATIVE EMBODIMENTS

Figure 9:
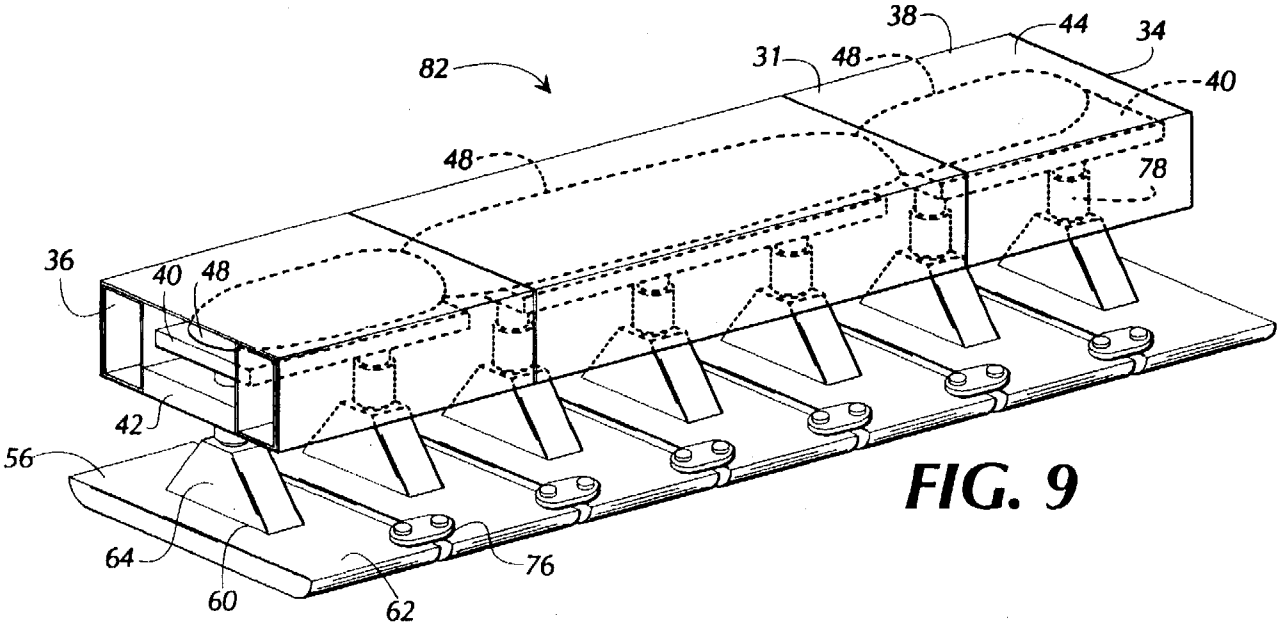
FIG. 9 is a perspective view of a first alternative embodiment of the present invention.
Figure 10:
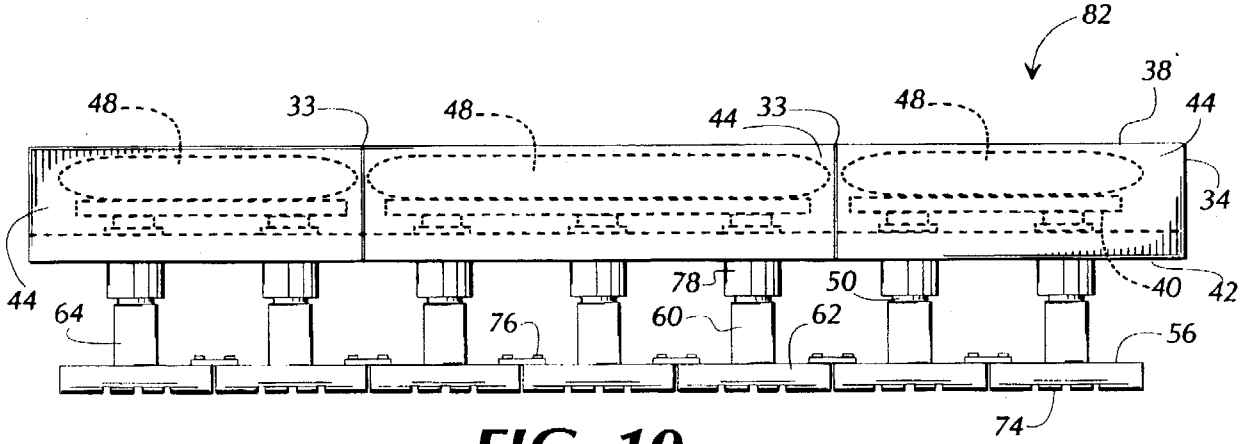
FIG. 10 is a front view of the alternative embodiment of FIG. 9.

A first alternative embodiment of the present invention is shown in FIGS. 9 and 10. The first alternative embodiment focuses on the number of loading plates 40 in each frame section 31. As discussed in detail above, the preferred embodiment includes a plurality of spaced apart, parallel loading plates 40 located between the cover plate 38 and the bottom plate 42 in each section 31. The first alternative embodiment shows a single loading plate 40 for each frame section 31. Thus, as the air bladder 48 in each section 31 is filled with air, the feet 56 in each section move substantially simultaneously as a result of the single loading plate 40 per section.

Figure 11:
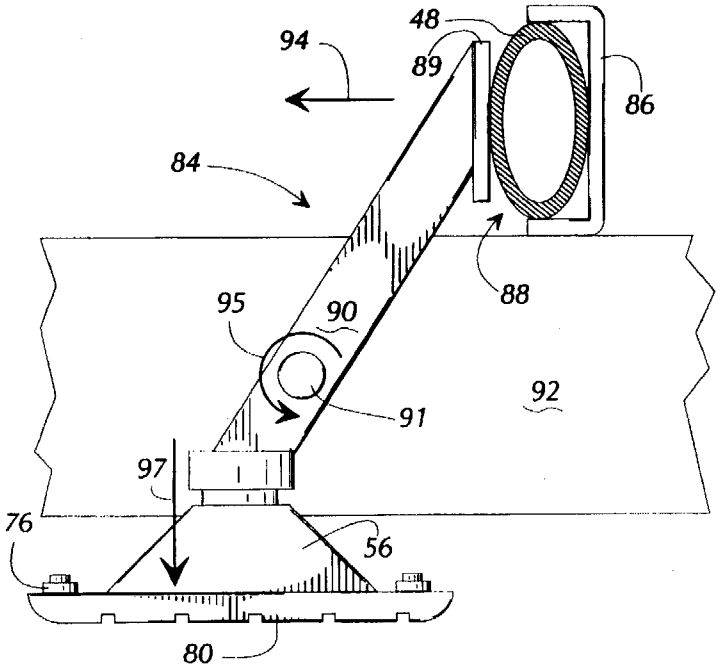
FIG. 11 is a perspective view of a second alternative embodiment of the present invention.

A second alternative embodiment 84 is shown in FIG. 11. The second alternative embodiment 84 is directed to an alternative manner of applying pressure to the adhering layers 18. In the second alternative embodiment 84, an air bladder channel 86 is mounted proximate and parallel to the corrugated board 10. The air bladder 48 as described in the preferred embodiment above, rests within the air bladder channel 86. The air bladder channel has an open section 88, the plane of which is perpendicular to the plane of the adhering layers 18. A pad 89 contacts the air bladder 48 in the open section 88. The pad 89 is fixed to a pivot rod 90. The pivot rod 90 is pivotably mounted on a pivot shaft 91 to a fixed member 92 proximate to and parallel with the adhering layers 18. The end of the pivot rod 90 opposite from the pad 89 is rotatably mounted to the pressure foot 56 as described in detail above with regard to the preferred embodiment.

When the air bladder 48 in the second alternative embodiment 84 is pressurized, the air bladder forces the pad 89 in the direction indicated by arrow 94. The force applied to the pad 89 causes the pivot rod 90 to pivot about the pivot shaft 91 as indicated by arrow 95 and pushes the foot 56 downward, shown by arrow 97 to apply pressure to the adhering layers 18 of the board 10.

Figure 12:
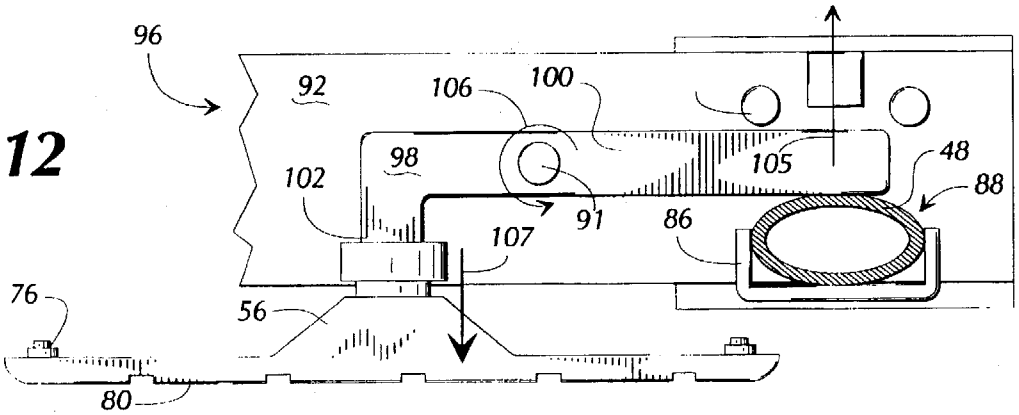
FIG. 12 is a perspective view of a third alternative embodiment of the present invention.

A third alternative embodiment 96 is shown in FIG. 12. The third alternative embodiment 96 includes an air bladder channel 86 as described above with regard to the second alternative embodiment 84. The air bladder channel 86 is oriented so that the open section 88 of the air bladder channel faces away from the adhering layers 18 of the board 10. The air bladder 48 within the air bladder channel 86 contacts an L-shaped member 98. The L-shaped member 98 has a long section 100 and a short section 102. The L-shaped member 98 is pivotably mounted along its long section 100 by means of a pivot shaft 91, as described above, to a parallel member 92. The parallel member 92 is mounted with respect to the third alternative embodiment 96 in a similar fashion as discussed above with regard to the second alternative embodiment 84. The short section 102 is connected to the pressure foot 56 by the spherical bearing 54 described above with regard to the preferred embodiment of the present invention. A stop 104 is fixed above the long section 100 of the L-shaped member 98.

In operation, the air bladder 48, when pressurized, forces the long section 100 of the L-shaped member in contact with the air bladder 98 upward as indicated by arrow 105. The L-shaped member pivots as result of the upward force of the air bladder 48 as indicated by arrow 106. This causes the short section 102 of the L-shaped member 98 to move downward and apply pressure to the pressure foot 56 and ultimately to the belt 22 and adhering layers 18 of the board 10 as shown by arrow 107. The stop 104 prevents the L-shaped member 98 from pushing too far downward on the belt 22 and board 10.

Figure 13:
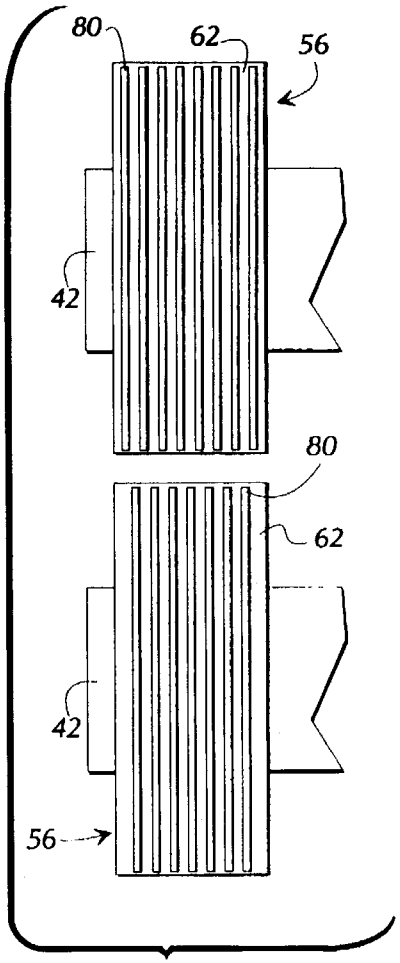
FIG. 13 is a bottom view of an alternative embodiment of FIG. 7.

There is also an alternative embodiment for the arrangement of the grooves 80 on the bottom surface of the pressure feet. In the preferred embodiment, the grooves are arranged at an angle to the center of the foot 56 as described in detail above. In this alternative embodiment, the grooves 80 will be parallel and spaced apart and each row of pressure feet arranged in a staggered fashion as shown in FIG. 13. This staggered arrangement allows the entire surface area of the upper belt 22 and lower belt 68 momentary exposure to the air to allow the belts to dry and to allow the heat and moisture to dissipate from them.

Figure 14:
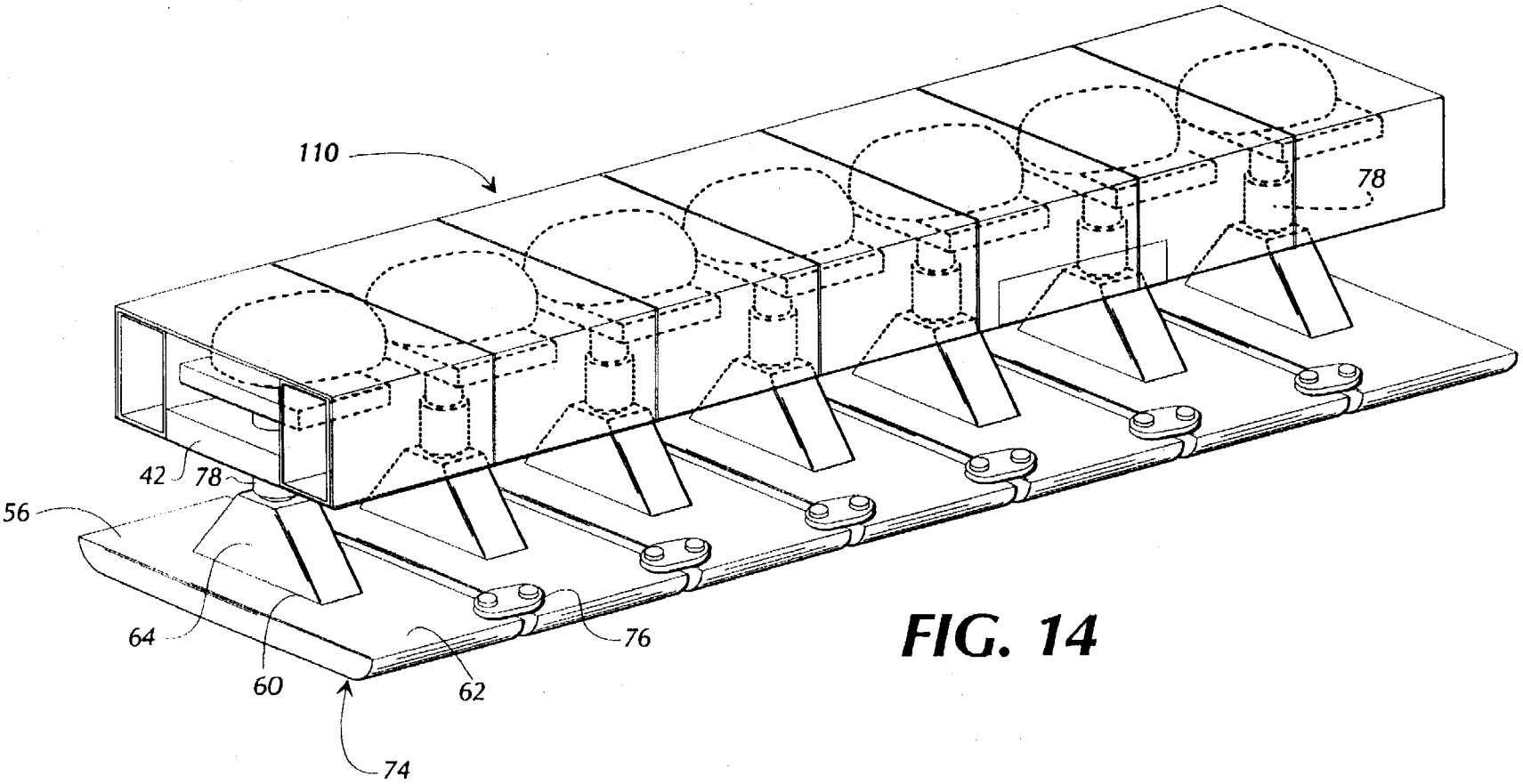
FIG. 14 is a fourth alternative embodiment of the present invention.

A fourth alternative embodiment 110 is shown in FIG. 14. This alternative embodiment is similar to the preferred embodiment except for the number of air bladders 48 and divider plates 33 between frame sections 31. In this embodiment, each loading plate 40 has a separate air bladder associated therewith. Each air bladder 48 is controlled separately thus allowing fine adjustment of the application of pressure to the pressure feet 56 across the width of the corrugated board 10. This, in part, allows for the uniform removal of moisture across the width of the corrugated board 10 to prevent the board from warping.

It will be appreciated that the embodiments discussed above are the preferred embodiments, and that various alternative embodiments are contemplated, falling within the scope of the appended claims. For example, the present invention could apply to any manufacturing situation where it is desirable to apply variable pressure to a surface.

We claim:

1. A device for dissipating moisture from a moving surface, comprising:

a hot member;

a conveyor for moving a surface relative to the hot member, the hot member positioned adjacent to the moving surface;

a frame positioned proximate to the hot member so that the moving surface moves between the frame and the hot member;

a plurality of pressure applicators mounted on the frame for applying pressure to the moving surface, the pressure applicators forming a row of pressure applicators substantially transverse to the direction of movement of the moving surface;

each pressure applicator comprising, at least one foot mounted in movable relation to the frame, and a variable pressure source operable for variably biasing the foot away from the frame and toward the moving surface; and a control device for varying the pressure supplied by each variable pressure source.

2. The device of claim 1 wherein each pressure applicator comprises a plate in contact with an expandable cavity capable of being pressurized, the cavity being housed within the frame; a rod extending outwardly from the plate and towards the surface; and a foot extending from the rod and in contact with the traveling surface.

3. The device of claim 2 wherein the expandable cavity comprises an elastic envelope capable of receiving pressurized fluid.

4. The device of claim 3 wherein the fluid is air.

5. The device of claim 2 further comprising an alignment means for maintaining alignment of each pressure applicator with respect to the frame.

6. The device of claim 5 wherein the alignment means comprises a bearing.

7. The device of claim 1 wherein each pressure applicator is configured to contact the traveling surface.

8. The device of claim 1 wherein each pressure applicator has an anti-friction material configured for contact with the traveling surface.

9. The device of claim 8 wherein the anti-friction material is a ceramic.

10. The device of claim 1 wherein each pressure applicator has spaced apart ribs extending toward the traveling surface.

11. The device of claim 11 wherein each pressure applicator comprises a plate in contact with an expandable cavity capable of being pressurized, the cavity being housed within the frame; a member pivotably mounted to the frame and extending outwardly from the plate and towards the surface; and a foot extending from the plate and configured for contact with the traveling surface.

12. The device of claim 1 wherein each pressure applicator comprises an L-shaped member in contact with an expandable cavity, the cavity capable of being pressurized and the cavity being housed within the frame, the L-shaped member being pivotably mounted to the frame and extending outwardly from the plate and towards the surface; and a foot extending from the L-shaped member and configured for contact with the traveling surface.

13. The device of claim 1, wherein the pressure supplied by each variable pressure source is regulated independently.

14. The device of claim 1, wherein:

the pressure applicators are grouped into a plurality of commonly regulated zones; and the pressure supplied by each zone is regulated independently.

15. The device of claim 1, wherein the traveling surface comprises corrugated paperboard.

16. A device for providing variable pressure to a moving surface comprising:

a frame;

a conveyor for moving a surface relative to the frame, the frame positioned proximate to the moving surface;

a plurality of pressure applicators mounted on the frame for applying pressure to the moving surface, the pressure applicators forming a plurality of rows of pressure applicators, each row being substantially transverse to the direction of movement of the moving surface;

each pressure applicator comprising, at least one foot, and a variable pressure source operable for variably biasing the foot away from the frame and toward the moving surface; and a control device for varying the pressure supplied by each variable pressure source.

17. The device of claim 16, wherein the pressure supplied by each variable pressure source is regulated independently.

18. The device of claim 16, wherein:

each row of pressure applicators is grouped into a plurality of commonly regulated zones; and the pressure supplied by each zone is regulated independently.

19. The device of claim 16, wherein each variable pressure source comprises at least one inflatable air bladder.

20. The device of claim 16, wherein the control device comprises a programmed logic controller.

* * * * *